United States Patent [19]

Kobayashi et al.

[11] Patent Number: 4,810,556

[45] Date of Patent: Mar. 7, 1989

[54] VERY SOFT POLYOLEFIN SPUNBONDED NONWOVEN FABRIC

[75] Inventors: Yoshinori Kobayashi, Iwakuni; Naoyuki Tamura; Takanobu Sakai, both of Waki; Yoshinori Yoshida, Yuu, all of Japan

[73] Assignee: Mitsui Petrochemical Industries, Ltd., Tokyo, Japan

[21] Appl. No.: 102,431

[22] Filed: Sep. 29, 1987

[30] Foreign Application Priority Data

Sep. 29, 1986 [JP] Japan ..... 61-230771
Feb. 16, 1987 [JP] Japan ..... 62-31585
May 18, 1987 [JP] Japan ..... 62-118957

[51] Int. Cl.[4] ..... D04H 1/04

[52] U.S. Cl. ..... 428/152; 428/224; 428/284; 428/296; 428/297; 428/340; 428/913

[58] Field of Search ..... 428/152, 224, 296, 340, 428/195, 297, 913, 284

[56] References Cited

U.S. PATENT DOCUMENTS 4,342,807 8/1982 Rosen et al. ..... 428/296
4,434,204 2/1984 Hartman et al. ..... 428/296
4,626,467 12/1986 Hostetter ..... 428/296
4,644,045 2/1987 Fowells ..... 428/296
4,748,065 5/1988 Tanikella ..... 428/152
4,766,029 8/1988 Brock et al. ..... 428/296

*Primary Examiner*—James J. Bell
*Attorney, Agent, or Firm*—Sherman & Shalloway

[57] ABSTRACT

Disclosed are a very soft polyolefin spunbonded nonwoven fabric and its production method. The polyolefin spunbonded nonwoven fabric according to the present invention is defined as (A) being formed of continuous polyolefin fibers having a fineness of 0.5 to 3 denier, (B) having basic weight between 30 g/m$^2$ and 15 g/m$^2$, and (C) having $\sqrt{S_{MD} \times S_{TD}}$ of 2.5 g or below, wherein $S_{MD}$ and $S_{TD}$ are respectively the softnesses in the machine and transverse directions as measured by a handle-O-meter. The method of producing a strip of very soft polyolefin nonwoven fabric by directing polyolefin continuous fibers in a fixed direction, comprises the steps of: orienting the axes of the continuous fibers in the direction in which the continuous fibers are fed so as to form a web having a warp orientation factor (the maximum tensile strength in the direction in which the continuous fibers are fed, i.e., in a machine direction/-the maximum tensile strength in a transverse direction) of 3.0 or above; and then applying wave-like crepes propagated in the machine direction to the web by creping the web.

4 Claims, 2 Drawing Sheets

VERY SOFT POLYOLEFIN SPUNBONDED NONWOVEN FABRIC

BACKGROUND OF THE INVENTION

1. Field of the Invention

The present invention relates to a very soft spunbonded nonwoven fabric formed of a polyolefin.

2. Description of the Prior Art

Spunbonded nonwoven fabrics have been widely used as various types of everyday items or industrial materials because they have good mechanical properties, such as tensile strength, due to the fact that they are formed from continuous fibers, when compared with other dry or wet non-woven fabrics.

Of the various types of spunbonded nonwoven fabrics available, those made of a polyamide, such as nylon, or a polyester, such as polyethylene terephthalate, have relatively high softness. Therefore, attempts have recently been made to use them as materials which make direct contact with the human body, such as in disposable sheets or the top sheets of diapers.

However, spunbonded nonwoven fabrics made of a polyolefin are not as soft as those of other materials, although they have excellent water resistance and chemical resistance and are inexpensive, and hence their application has been limited to specific fields. Examples include use in the civil engineering field as drainage materials, in the agricultural field as covering materials, and various other specific fields as carpet bases. Of course, the application of polyolefin spunbonded nonwoven fabrics in the above-described field of materials such as the top sheets of disposable diapers has been gradually increasing, because their other properties, apart from softness, are superior to those of spunbonded fabrics made of other materials. If the softness of polyolefin spunbonded nonwoven fabrics could be improved, their fields of application can be expected to expand widely in the future because of their many other excellent properties.

SUMMARY OF THE INVENTION

Accordingly, a primary object of the present invention is to provide a very soft polyolefin spunbonded nonwoven fabric, and a second object of the present invention is to provide a polyolefin spunbonded nonwoven fabric which has excellent softness and mechanical strength, and which feels good to the skin but strong.

When a nonwoven fabric is used as top sheets of paper diapers or the like, it is required to have a good mechanical strength, such as a good wear resistance. However, it is very difficult to a nonwoven fabric which is both very soft and wear-resistant. In other words, if it is embossed during its manufacturing process to make it wear-resistant, it becomes wear-resistant in accordance with the degree of embossing applied thereto, but it also becomes corresponding less soft.

Accordingly, a third object of the present invention is to provide a method of producing a nonwoven fabric which enables the manufactured nonwoven fabric to become soft while remaining wear-resistant.

In order to make a nonwoven fabric soft, it is subjected to a process called creping.

When the nonwoven fabric is pressed from above by a pressing body as it is moved by a roll or the like, the surface of the nonwoven fabric is moved at a speed faster than that at which deeper portions thereof are fed, owing to the frictional resistance generated by the contact of the fabric with the pressing body. The principle of creping lies in the fact that the nonwoven fabric is crinkled by this difference in speed.

However, if an excessive force is applied to the nonwoven fabric by the pressing body during the creping process, or if the nonwoven fabric is fed too fast, the fibers may be melted by the frictional heat generated by the process, or cracked, or mixed with foreign matter resulting from the generation of lint, or, static electricity or lint may be generated, thus making any speeding up of the creping operation difficult.

A fourth object of the present invention is to provide a method of producing a nonwoven fabric which does not allow the nonwoven fabric to be deteriorated by the frictional heat generated during the creping of the fabric, and which enables the speeding up of the creping operation so as to increase productivity.

To this end, the invention provides, in one of its aspects, a very soft polyolefin spunbonded nonwoven fabric characterized by being defined as (A) being formed of continuous polyolefin fibers which have a fineness of 0.5 to 3 denier, (B) having basic weight between 30 g/m$^2$ and 15 g/m$^2$, and (C) having $\sqrt{S_{MD} \times S_{TD}}$ of 2.5 g or below, wherein $S_{MD}$ and $S_{TD}$ are the softnesses measured by a handle-O-meter in the machine and transverse directions, respectively.

The invention provides, in another of its aspects, a very soft polyolefin spunbonded nonwoven fabric characterized by having a final basic weight of 30 g/m$^2$ or below, the final basic weight being provided to the nonwoven fabric by creping a web in a wave-like fashion in a machine direction, the web being formed by orienting the axes of polyolefin continuous fibers having a fineness of 0.5 to 3 denier in the machine direction, the web having a warp orientation factor (the maximum tensile load that can be applied to the web in the machine direction/the maximum tensile load that can be applied in the transverse direction) of 3.0 or above and a basic weight of 29 g/m$^2$ or below.

The invention provides, in another of its aspects, a method of producing a strip of nonwoven fabric by causing polyolefin continuous fibers to flow in a fixed direction, which comprises the steps of: forming a web having warp orientation factor (maximum tensile load that can be applied in the direction in which said continuous fibers are fed, i.e., in a machine direction/the maximum tensile load that can be applied in a transverse direction) of 3.0 or above by orienting the axes of the continuous fibers in the direction of flow thereof; and then applying the web with wave-like crepes propagated in the machine direction by creping the web.

The invention provides, in another of its aspects, a method of producing a nonwoven fabric which includes the step of coating a lubricant on a portion of the nonwoven fabric which makes contact with a pressing body and which is located upstream of the contacting portion as the soft nonweoven fabric is formed by pressing the pressing body against the surface of the nonwoven fabric which is being moved on a drive surface.

DESCRIPTION OF THE PREFERRED EMBODIMENTS

Figure 1:
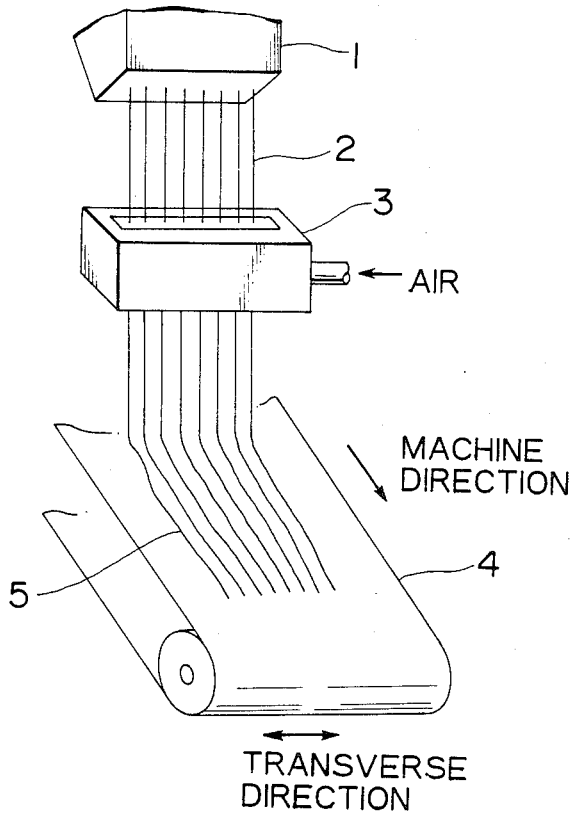
FIG. 1 is a perspective view of an example of an apparatus for producing a spunbonded nonwoven fabric according to the present invention.

A polyolefin spunbonded nonwoven fabric according to the present invention is formed of polyolefin continuous fibers. The employed polyolefin continuous fibers have a fineness of 0.5 to 3 denier, and more preferably, 1 to 2.5 denier. If the fibers have a fineness which is below this range, the resultant nonwoven fabric cannot be strong enough. A fineness of the fibers which is above this range does not ensure sufficient softness of the resultant fabric.

Polyolefins which form the continuous fibers include: a polymer or a copolymer of an α-olefin such as ethylene, propylene, 1-butene, 3-methyl-1-butene, 3-methyl-1-pentene, 4-methyl-1-pentene, 1-heptene, 1-hexane, 1-oxtene, or 1-decen; a copolymer of any of the above-described α-olefins and an unsaturated carboxylic acid such as maleic acid or Nadic acid, ester of any of the unsaturated carboxylic acids or an unsaturated carboxylic acid group such as an anhydride; and a blend of the above-described substances. Polyolefins which are mainly formed of any of these substances and are mixed with a small amount of other polymers may also be employed as polyolefins in the present invention.

The nonwoven fabric according to the present invention has basic weight of 30 g/m$^2$ or below, and preferably, 26 g/m$^2$ or below. To ensure sufficient strength and opacity, the lower limit of basic weight is set at 15 g/m$^2$. Setting basic weight of a nonwoven fabric which is formed of fibers having a fineness in the above range to any value between 30 g/m$^2$ and 15 g/m$^2$ produces a nonwoven fabric which has a high softness and mechanical strength.

The nonwoven fabric according to the present invention can withstand a tensile strength of up to 4 kg/5 cm of width or above, and preferably, up to 5 kg/5 cm of width or above, in the machine direction, and a tensile strength of up to 0.5 kg/5 cm of width or above, and preferably, up to 0.8 kg/5 cm of width or above, in the transverse direction. The nonwoven fabric, which has a tensile strength set in this range, has sufficient softness and tensile strength at the same time.

The terms "machine direction" and "transverse direction" as used herein mean the direction in which the nonwoven fabric is fed during manufacture and the direction perpendicular to the direction in which the nonwoven fabric is fed, respectively.

Wherein $S_{MD}$ (g) and $S_{TD}$ (g) are respectively the softnesses of the nonwoven fabric as measured by a handle-0-meter in the machine and transverse directions, $\sqrt{S_{MD} \times S_{TD}}$ of the nonwoven fabric according to the present invention is 2.5 g or below, which proves that the nonwoven fabric of the invention is very soft. Preferably, $S_{MD}$ and $S_{TD}$ are 4.5 or below and 2.5 or below, respectively.

The very soft nonwoven fabric according to the present invention which has been defined above may be provided by intentionally orienting the filaments in the machine direction so as to provide a raw nonwoven fabric and then by creping the raw nonwoven fabric in which it is applied with wave-like crepes propagated in the machine direction.

Orientation of filaments in the machine direction produces a nonwoven fabric which is very soft in the transverse direction. The obtained nonwoven fabric, however, is not soft enough in the machine direction. Therefore, it is subjected to a creping process in which it is applied with wave-shaped crepes propagated in the machine direction to make it soft in the machine direction.

A nonwoven fabric which is made soft in the transverse direction by orienting the filaments in the machine direction can be manufactured by a known technique.

More specifically, a technique for forcibly orienting the filaments in the machine direction for the purpose of improving susceptibility to tearing in the machine direction has been known. In this technique, molten polymer is, for example, attenuated into filaments 2 by being extruded from orifices 1, as shown in FIG. 1. An air stream which emerges from an air sucker 3 then collects the filaments on a moving surface A. As the filaments are landed on the moving surface 4, they are oriented in the direction in which they are moved so as to provide a raw nonwoven fabric 5 which meets the requirements of the prevent invention. A raw nonwoven fabric which can be used in the present invention may also be obtained by a method disclosed in the specification of Japanese Patent Publication No. 24991/1972, by suitably adjusting the speed of supply of the filaments and the speed at which the collecting surface is moved. Japanese Patent Laid-Open No. 112273/1979 and Japanese Patent Laid-Open No. 70060/1986 have also proposed techniques for manufacturing a spunbonded nonwoven fabric in which the filaments are oriented in the machine direction.

The term "orienting the filaments in the direction in which they are fed" as used herein means directing the axes of the filaments in the direction in which they are moved. This includes, in addition to a case in which the axes of the filaments are disposed in a direction parallel to the direction in which the filaments are fed, a case in which the filaments are entangled with each other to some extent and are inclined with respect to the direction in which they are fed but are directed on the whole in the direction in which they are fed.

If orientation of the axes of the filaments in the direction in which they are fed is effected according to any of the known techniques, the resultant nonwoven fabric has high softness in the transverse direction but low softness in the machine direction. This tendency of a nonwoven fabric to become less soft in the machine direction increases as the degree of orientation of the filaments is increased. Also, the tensile loads that can be applied to the nonwoven fabric in the machine and transverse directions without breakage thereof becomes imbalanced as the degree of orientation is increased. Concretely, the tensile load that can be applied in the machine direction increases, while that in the transverse direction decreases. Therefore, there is a limit to the ability to increase softness in the transverse direction in terms of balancing the strength of the nonwoven fabric at a level at which the fabric can be shaped and withstand use, as well as from the viewpoint of the capacity of manufacturing apparatus employed. Generally, the lowest limit of the softness that can be applied to a nonwoven fabric is $S_{TD} \geqq 1.0$ g. At this time, the softness in the machine direction $S_{MD}$ is naturally 4.5 g or above, and substantially 5 g or above. The tensile load that can be applied in the machine direction is up to 4 kg/5 cm of width or above, and substantially up to 6 kg/5 cm of width or above, and the tensile load that can be applied in the transverse direction is up to 0.5 kg/5 cm of width or above, and substantially up to 1 kg/5 cm of width or above.

If the degree of orientation of the filaments in the machine direction is expressed using a warp orientation factor (which is defined as "the maximum tensile strength that can be applied to the filaments in the machine direction without breakage thereof/the maximum tensile strength that can be applied thereto in the transverse direction" if the machine direction is a direction in which the filaments are fed), the web which is formed according to the present invention has the warp orientation factor of 3.0 or above. This is because the web formed when the filaments are oriented in the machine direction has a high softness in the transverse direction and the desired softness is ensured by setting the warp orientation factor to 3.0 or above (see FIG. 4).

In order to make the raw nonwoven fabric soft in the machine direction, it is subjected to a creping process in which it is creped in a wave-like fashion in the machine direction. The term "creped in a wave-like fashion in the machine direction" as used herein means to propagate the crepe waves in the previously defined machine direction (in the direction in which the filaments are fed), and to displace them in a direction perpendicular to the machine direction. Creping the raw nonwoven fabric is effected by a known technique. For example, the upper surface of a raw nonwoven fabric 5 which is passing over by a roll 6 is pressed against a plate 7 having a rough sandpaper-like surface, the plate 7 constituting a pressing body 8, so that the raw nonwoven fabric 5 is crinkled in a wave-like fashion in the direction of movement thereof, i.e., in the machine direction by the frictional force of the pressing.

A lubricant may be coated to a portion of the nonwoven fabric which makes contact with the pressing body 8 and which is located upstream this contacting portion.

By coating the lubricant, the frictional resistance can be reduced, thereby restricting the generation of the frictional heat.

The surface of the nonwoven fabric is not damaged by creping the fabric. Creping makes it possible for the speed at which the nonwoven fabric is fed to be increased, thereby increasing productivity.

Figure 2:
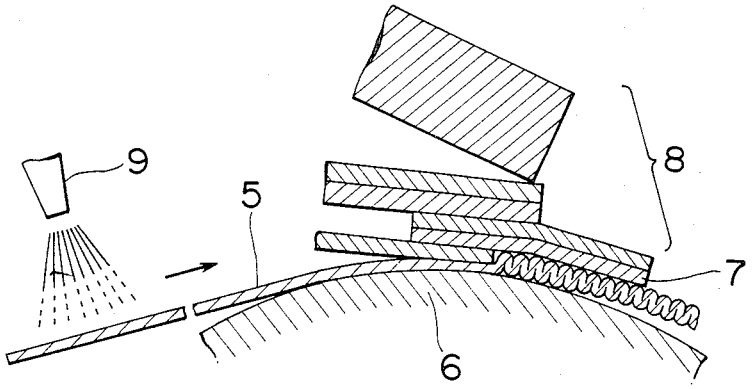
FIG. 2 is a cross-sectional view of a creping machine employed to produce the spunbonded nonwoven fabric according to the present invention.
Figure 3:
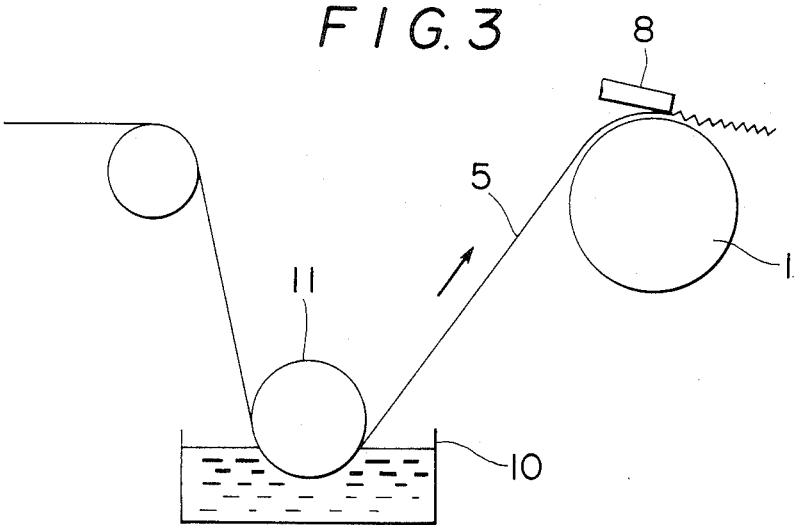
FIG. 3 shows another example of the creping machine which may be used in the present invention.

The lubricant may be coated by a spray method in which a spray gun 9 is used to coat the lubricant, as shown in FIG. 2, by guiding the nonwoven fabric 5 into a reservoir 10 so as to immerse it in the lubricant contained in the reservoir 10, as shown in FIG. 3, or by gravure coating method (not shown) in which the lubricant contained in a reservoir is coated to the nonwoven fabric by an etched roll.

Lubricants employed include those which can reduce frictional resistance of the nonwoven fabric without affecting the properties of the nonwoven fabric, such as water, an aqueous solution of surface-active agent, or an aqueous solution of waterproofing agent, and those which can reduce frictional resistance and improve the properties of the nonwoven fabric when they are coated thereon.

If a modifier of the nonwoven fabric such as a surface-active agent is applied as a lubricant as a lubricant, it can be uniformly spread over the entire surface of the nonwoven fabric by the pressing body, enabling the nonwoven fabric to be uniformly modified.

A lubricant must be coated to the nonwoven fabric in an appropriate amount, since an excessive coating generates slippage of the nonwoven fabric and prohibits it from being creped. Generally, it is coated in an amount which ranges between 0.1 to 1 g/m$^2$, although the exact amount of the lubricant applied differs in accordance with the type of fiber component, basic weight of the nonwoven fabric, or the speed at which the nonwoven fabric is fed.

The degree of softness in the transverse direction that can be provided to the nonwovan fabric by creping is varied in response to the degree of creping to be conducted. However, there is a limit to the degree of creping from viewpoints of productivity and capacity of the apparatus employed. If the final objective value of the softness is to be $S_{MD} \leqq 4.5$ g and $\sqrt{S_{MD} \times S_{TD}} \leqq 2.5$ g, a raw nonwovan fabric having $4.5 < S_{MD} \leqq 7$ g and $2.5 < \sqrt{S_{MD} \times S_{TD}} \leqq 3.5$ g is preferebly used as an object of creping.

By creping it, the raw nonwoven fabric becomes slightly softer in the transverse direction, as well as in the machine direction. If the objective softness in the transverse direction is to be 2.5 g or less, a nonwoven fabric which has a $S_{TD}$ of 2.8 g can be employed, and the resultant nonwoven fabric has a final softness of 2.5 g.

Creping affects the maximum tensile strength that can be applied to the nonwoven fabric without breakage thereof, that is, creping tends to reduce the maximum tensile strength. Therefore, if the final objective maximum tensile strength are to be 4 kg/5 cm of width or above in the machine direction and 5 kg/5 cm of width or above in the transverse direction, it is safe to set the the maximum tensile strength of a raw nonwoven fabric at 5 kg/5 cm of width or above, preferably, 5.5 kg/5 cm of width or above, in the machine direction, and at 0.6 kg/5 cm of width or above, and preferably, 0.8 kg/5 cm of width or above, in the transverse direction.

Creping also affects basic weight. It is therefore safe to employ a raw nonwoven fabric having basic weight which is less by 1 g/m$^2$ or less, preferably, by 2 g/m$^2$ or less, than that of the final product.

The thus-obtained very soft nonwoven fabric may be subjected to a known processing such as embossing or needle-punching process, or it may be applied with a hydrophilic agent or a water repellant.

If embossing is carried out with the nonwoven fabric of this invention, it is done to the web by an embossing calender before it is creped. If the web is subjected to the above-described process, its softness is not reduced even if it is embossed.

(EMBODIMENTS)

Experimental examples of the present invention will now be described below.

EXPERIMENTAL EXAMPLES 1 to 16

Nonwoven fabric (Comparison Example 1) was formed by the spunbonded method by directing polypropylene filaments at random, and nonwoven fabrics (Examples 2 to 16) were formed by the spundbonded method by orienting polypropylene filaments in the direction in which they are fed (in the machine direction). Various properties of each example were then measured. The softnesses of the fabrics in the machine and transverse directions were measured by using a handle-O-meter.

Table 1 shows the results of the measurements. As can be seen from the table, when the axes of the filaments were oriented in the machine direction, the resultant raw nonwoven fabrics were softer in the transverse direction than that formed by directing the filaments at random. However, it is also clear that they substantially have no softness in the machine direction.

Substantially, the raw nonwoven fabrics were subjected to creping so as to obtain nonwoven fabrics which were creped in the wave-like fashion in the machine direction. Various properties of the obtained nonwoven fabrics were then measured.

Table 1 shows the results of the measurements.

Experimental Examples 7 to 16 represent nonwoven fabrics which could meet the requirements of this invention.

Figure 4:
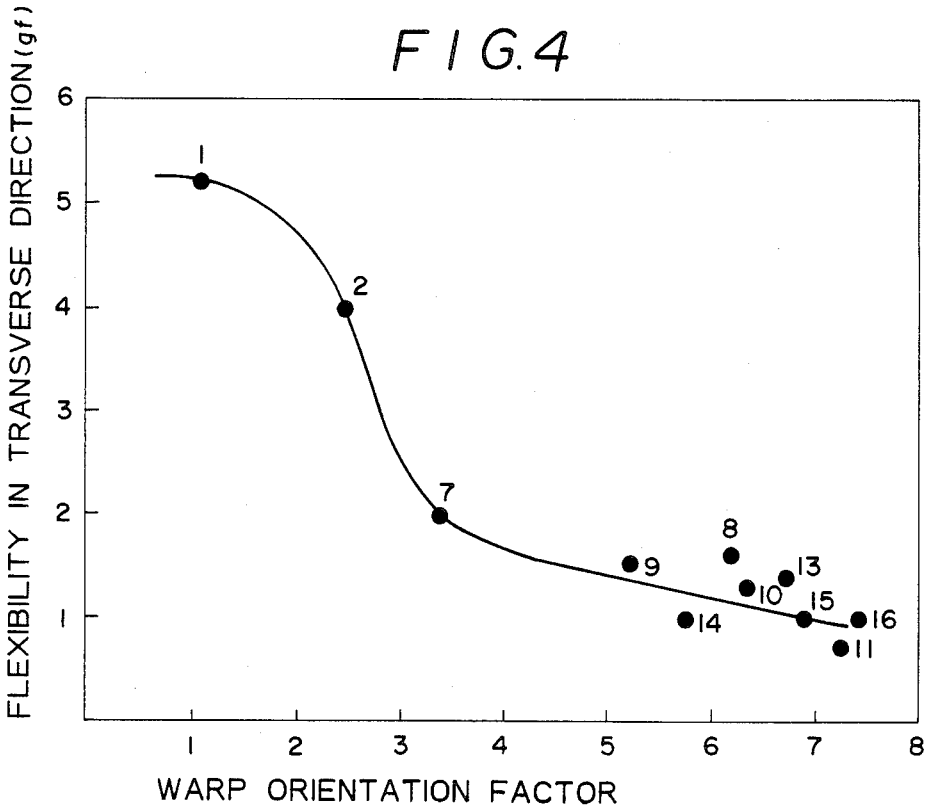
FIG. 4 is a graph illustrating the relationship between warp orientation factor and the softness in the transverse direction.

In addition, FIG. 4, which is a graph showing the relationship between the warp orientation factor and the softness of the creped nonwoven fabric in the transverse direction, also proves that Experimental Examples 7 to 16 showed good results.

face of each of the nonwoven fabrics before and after the creping, the generation of lint, and the softness could be organoleptically evaluated. Table 2 shows the results of the experiments.

In the table, the levels of lint generated were divided into five stages which were represented by 1 (very much), 2 (much), 3 (some), 4 (a little), and 5 (very little). The degree of softness was expressed by four levels 1 to 4, which means: 1, the fibers were substantially melted, and became a brittle sheet-like material; 2, the fibers were partially melted, holes were made at some locations and the fibers became brittle; 3, some of the fibers were partially melted, and became slightly rough; and 4, the fibers were very soft.

As can be seen from the table, when water was sprayed on the nonwoven fabric as the fabric was being creped, speeding up the feed of the nonwoven fabric caused no abnormality on the surface of the resultant nonwoven fabric. However, when no water was sprayed and the nonwoven fabric was fed at an increased speed, the surface of the nonwoven fabric was

TABLE 1

| Experimental Example | Fineness | Basic Weight g/m² | Maximum Tensile Strength Kg/5 cm of width MD | TD | Elongation at Max. Tensile Strength % MD | TD | Softness g $S_{ND}$ | $S_{TD}$ | $\sqrt{S_{MD} \cdot S_{TD}}$ | Warp Orientation Factor |
|---|---|---|---|---|---|---|---|---|---|---|
| | | Raw Nonwoven Fabric | | | | | | | | |
| 1 | 2 | 25.8 | 5.0 | 4.5 | 31 | 34 | 5.8 | 5.2 | 5.5 | 1.1 |
| 2 | 2 | 25.1 | 6.2 | 2.5 | 31 | 35 | 6.0 | 4.2 | 5.0 | 2.5 |
| 3 | 4 | 30.0 | 11.0 | 2.3 | 35 | 40 | 8.3 | 2.9 | 4.9 | 4.8 |
| 4 | 4 | 33.2 | 13.3 | 2.4 | 37 | 45 | 10.5 | 4.2 | 6.6 | 5.5 |
| 5 | 4 | 28.5 | 9.8 | 2.0 | 35 | 42 | 8.2 | 3.6 | 5.4 | 4.9 |
| 6 | 4 | 23.8 | 8.5 | 1.8 | 35 | 43 | 6.7 | 2.9 | 4.4 | 4.7 |
| 7 | 2 | 25.1 | 7.0 | 2.1 | 25 | 37 | 6.5 | 1.8 | 3.4 | 3.4 |
| 8 | 2 | 25.1 | 7.4 | 1.3 | 23 | 30 | 6.9 | 1.6 | 3.3 | 6.2 |
| 9 | 2 | 25.5 | 9.2 | 1.8 | 32 | 39 | 7.1 | 1.6 | 3.4 | 5.1 |
| 10 | 2 | 22.7 | 8.0 | 1.3 | 30 | 40 | 6.0 | 1.4 | 2.9 | 6.2 |
| 11 | 2 | 18.5 | 6.5 | 0.9 | 30 | 40 | 5.0 | 1.0 | 2.2 | 7.2 |
| 12 | 1.5 | 22.5 | 7.8 | 1.5 | 31 | 38 | 5.3 | 1.0 | 2.3 | 5.2 |
| 13 | 2 | 24 | 8.0 | 1.2 | 23 | 35 | 5.6 | 1.8 | 3.2 | 6.7 |
| 14 | 2 | 24 | 9.9 | 1.7 | 26 | 47 | 5.7 | 1.3 | 2.7 | 5.8 |
| 15 | 2 | 24 | 9.0 | 1.3 | 25 | 35 | 5.5 | 1.5 | 2.9 | 6.9 |
| 16 | 2 | 22 | 8.0 | 1.1 | 25 | 35 | 5.0 | 1.3 | 2.5 | 7.3 |
| | | After Creped | | | | | | | | |
| 1 | 2 | 27.6 | 5.0 | 4.6 | 45 | 34 | 2.1 | 5.1 | 3.3 | |
| 2 | 2 | 27.1 | 6.3 | 2.5 | 45 | 35 | 2.5 | 4.0 | 3.2 | |
| 3 | 4 | 32.0 | 10.5 | 2.0 | 29 | 43 | 5.2 | 2.8 | 3.8 | |
| 4 | 4 | 35.0 | 12.0 | 2.2 | 25 | 45 | 6.9 | 4.0 | 5.3 | |
| 5 | 4 | 30.0 | 9.5 | 1.7 | 27 | 46 | 5.7 | 3.5 | 4.5 | |
| 6 | 4 | 25.0 | 8.0 | 1.4 | 26 | 45 | 4.8 | 2.8 | 3.7 | |
| 7 | 2 | 27.2 | 7.2 | 2.2 | 43 | 35 | 2.7 | 1.8 | 2.2 | |
| 8 | 2 | 27.2 | 7.4 | 1.5 | 41 | 30 | 2.7 | 1.6 | 2.1 | |
| 9 | 2 | 28.0 | 9.0 | 1.6 | 28 | 45 | 3.9 | 1.6 | 2.5 | |
| 10 | 2 | 24.0 | 7.5 | 1.2 | 25 | 45 | 3.2 | 1.3 | 2.0 | |
| 11 | 2 | 20.0 | 6.0 | 0.8 | 25 | 43 | 2.5 | 0.8 | 1.4 | |
| 12 | 1.5 | 24.0 | 7.2 | 1.3 | 25 | 45 | 2.9 | 1.0 | 1.7 | |
| 13 | 2 | 25.5 | 7.2 | 1.1 | 24 | 33 | 3.2 | 1.5 | 2.2 | |
| 14 | 2 | 25.5 | 8.2 | 1.4 | 23 | 43 | 3.5 | 1.0 | 1.9 | |
| 15 | 2 | 25.5 | 8.0 | 1.1 | 25 | 35 | 3.5 | 1.0 | 1.9 | |
| 16 | 2 | 23.5 | 7.0 | 1.0 | 25 | 35 | 3.0 | 1.0 | 1.7 | |

Subsequently, water was sprayed on the polypropylene nonwoven fabrics (having basic weight of 25 g/m²) formed by the spunbonded method, and the nonwoven fabrics were then creped by a creping machine. At this time, factors such as the amount of water to be sprayed, the speed at which the nonwoven fabric was fed, and so forth were changed, so that the conditions of the surmelted, or the amount of lint generated became large. Spraying of an excessive amount of water caused slippage of the nonwoven fabric within the creping machine. This made creping of the nonwoven fabric and hence provision of softness to the nonwoven fabric difficult.

TABLE 2

| | Feed Speed m/min | Amount of Water Coated g/m² | Creping | Amount of Lint Generated | Condition of Creped Nonwoven Fabric: Softness | External View | Overall Evaluation |
|---|---|---|---|---|---|---|---|
| Reference Example 1 | 30 | 0 | Done | 3 | 3 | Surface of the web was melted and became rough. | Good |
| Example 1 | 50 | 0.2 | Done | 5 | 4 | Had an external view similar to that of the raw web, and showed excellent softness. | Very Good |
| Example 2 | 50 | 0.5 | Done | 5 | 4 | Had an external view similar to that of the raw web, and showed excellent softness. | Very Good |
| Comparison Example 1 | 50 | 0 | Done | 2 | 2 | Surface of the web was melted and became rough. | Bad |
| Comparison Example 2 | 50 | 1 | Not Done | 5 | — | Web could not be creped owing to slippage. | Bad |
| Example 3 | 100 | 0.3 | Done | 5 | 4 | Had an external view similar to that of the raw web, and showed excellent softness. | Very Good |
| Example 4 | 100 | 0.7 | Done | 5 | 4 | Had an external view similar to that of the raw web, and showed excellent softness. | Very Good |
| Comparison Example 3 | 100 | 0 | Done | 1 | 2 | Surface of the web was melted, and holes were formed therein. | Bad |
| Comparison Example 4 | 100 | 1.5 | Not Done | 5 | — | Web could not be creped owing to slippage. | Bad |
| Example 5 | 150 | 0.4 | Done | 5 | 4 | Had an external view similar to that of the raw web, and showed excellent softness. | Very Good |
| Example 6 | 150 | 1 | Done | 5 | 4 | Had an external view similar to that of the raw web, and showed excellent softness. | Very Good |
| Comparison Example 5 | 150 | 0 | Done | 1 | 1 | There was no softness at all, and the fabric was damaged. | Bad |
| Comparison Example 6 | 150 | 2 | Not Done | 5 | — | Web could not be creped owing to slippage. | Bad |

What is claimed is:

1. A very soft polyolefin spunbonded nonwoven fabric characterized by being defined as (A) being formed of continuous polyolefin fibers having a fineness of 0.5 to 3 denier, (B) having basic weight between 30 g/m² and 15 g/m², and (C) having $\sqrt{S_{MD} \times S_{TD}}$ of 2.5 g or below, wherein $S_{MD}$ and $S_{TD}$ are respectively the softnesses in the machine and transverse directions as measured by a handle-O-meter.

2. A very soft polyolefin spunbonded nonwoven fabric according to claim 1, wherein said fabric has a maximum tensile strength of 4 kg/5 cm of width or above in the machine direction, and the maximum tensile strength of 0.5 kg/5 cm of width or above in the transverse direction.

3. A very soft polyolefin spunbonded nonwoven fabric according to claim 1, wherein said polyolefin is a polymer or a copolymer of an α-olefin such as ethylene, propylene, 1-butene, 3-methyl-1-butene, 3-methyl-1-pentene, 4-methyl-1-pentene, 1-heptene, 1-hexane, 1-oxtene, or 1-decen; a copolymer of any of the above-described α-olefins and an unsaturated carboxylic acid such as maleic acid or Nadic acid, ester of any of the unsaturated carboxylic acids or an unsaturated carboxylic acid group such as an anhydride; a blend of the above-described substances; and any of the thus-obtained poleolefins which is mixed with a small amount of other polymers.

4. A polyolefin spunbonded nonwoven fabric characterized by having a final basic weight of 30 g/m² or less, said final basic weight being provided to said nonwoven fabric by applying wave-like crepes propagated in a machine direction to a web which is formed by orienting the axes of polyolefin continuous fibers having a fineness of 0.5 to 3 denier in said machine direction and which has warp orientation factor (the maximum tensile strength in the machine direction/the maximum tensile strength in the transverse direction) of 3.0 or above and a basic weight of 29 g/m² or below.

* * * * *